United States Patent [19]

Gardner et al.

[11] 4,020,946

[45] May 3, 1977

[54] DISPLAY AND DISPENSING CARTON STRUCTURE AND BLANK THEREFOR

[76] Inventors: Marshall J. Gardner, 4040 Greenleaf Circle, Apt. 303, Kalamazoo, Mich. 49008; Jeff A. Gardner, 10142 Graefield, Portage, Mich. 49081

[22] Filed: Sept. 29, 1975

[21] Appl. No.: 617,312

[52] U.S. Cl. ..... 206/45.16; 206/491; 206/560; 206/817; 229/16 D; 229/38

[51] Int. Cl.[2] ..... B65D 5/50; B65D 1/34; B65D 5/08

[58] Field of Search ..... 206/74, 44.12, 817, 206/45.16, 491; 229/16 D, 38

[56] References Cited

UNITED STATES PATENTS

| | | | |
|---|---|---|---|
| 2,595,202 | 4/1952 | Pardee | 229/38 |
| 3,207,564 | 9/1965 | Patrick et al. | 206/44.12 |
| 3,227,266 | 1/1966 | Soma | 229/16 D |
| 3,231,077 | 1/1966 | Grimm | 229/16 D |
| 3,675,912 | 7/1972 | Des Jardins | 206/817 |

*Primary Examiner*—Stephen P. Garbe
*Assistant Examiner*—Douglas B. Farrow
*Attorney, Agent, or Firm*—Gordon W. Hueschen

[57] ABSTRACT

A novel display and dispensing carton and carton blank from which the same may be erected are disclosed. The display and dispensing carton is characterized by an arrangement of panels and securing means which allows the cartons to be readily erected from blanks, e.g., paperboard blanks, at the point of display, has side panels which slope rearwardly from the top edge of a front panel to a front edge of a top panel thereby to provide a diagonally-constituted display and dispensing opening, and is moreover characterized by the presence of an improved resiliently-biased follower adapted serially to urge merchandise placed in said carton toward the display and dispensing opening for display and ready removal thereof, the resilient bias being provided by a coil spring having parallel circular front and rear end convolutions located between the rear panel of the carton and the follower and having its front end convolution secured to the follower and its rear end convolution secured to the rear panel of the carton, preferably by a novel arrangement of substantially parallel slits in the rear panel adapted to receive the rear convolution of said coil spring.

24 Claims, 9 Drawing Figures

33
31
30
36
37
34
35
32
11
10
12
13
14
15
16
17
18
19
20
21
22
23
24
25
26
27

15
14
18
22-13
21-11
12-20
23-10
20-12

41
42
43
44
40

DISPLAY AND DISPENSING CARTON STRUCTURE AND BLANK THEREFOR

BACKGROUND OF THE INVENTION

1. Field of Invention

Display and dispensing cartons, blanks from which the same may be erected. Such cartons characterized by the presence of a resiliently-biased follower for urging merchandise toward a display and dispensing opening therein. Such carton which may be readily constructed of inexpensive sheetform material such as paperboard and which may be readily erected from an integral blank at the point of display.

2. Prior Art

The display of small objects on the shelves of merchants has long presented a problem. Efforts must be made not only to keep one product separate from another, the products of one manufacturer separate from the products of another, and the products of the same type but different sizes from intermingling with each other, but even when these factors do not present a major problem, there is still a necessity of replacing the merchandise on the shelves of the vendor, bringing additional quantities of the product from the rear of the shelf to the fore of the shelf where it may be observed by the potential customer, and in general maintaining good housekeeping so that the intended goods is available on display and hence for purchase, the display is well organized for inventory and observation purposes, and preferably confined to a certain area of the available shelf or counter space. These objectives are difficult to attain, especially with loose objects which can become readily intermixed and disarrayed by accident or by inconsiderate prospective purchasers, so that numerouse so-called "point of sale" or "point of merchandising" displays and display devices have in the past been provided to alleviate some of the aforementioned problems. Some of these display devices have been quite complex and large; others have been quite expensive. Few, if any, of them have considered particularly the problem of display of small objects such as pharmaceuticals, cosmetics, and notions, which may be uniformly packaged and conveniently displayed on shelves and counters. Those which have considered such merchandising area have not succeeded in providing inexpensive display devices which, if necessary or desirable, may be discarded after a few or even a single use. Moreover, such efforts as have been made along these lines have not resulted in a product which can be produced from an inexpensive sheetform material such as paperboard and readily provided in flat form which can be conveniently shipped and readily erected at the point of display from an integral blank. The product of the present invention eliminates previous problems in this area, provides a completely satisfactory display and dispensing carton which can be made from inexpensive sheetform material such as paperboard, which can be erected at the point of display from an integral blank, and which, despite its economy and convenience, nevertheless is so designed as to provide a neat-appearing carton having a readily available display and dispensing opening, and which may conveniently contain a resiliently-biased follower adapted serially to urge merchandise placed in the carton toward the display and dispensing opening for display and ready removal therefrom. Such objectives have not been attainable with any display and dispensing carton previously available.

According to the present invention, these objects are attained, and the point of display or point of sale can now also be considered the "point of erection" of a completely satisfactory, inexpensive, and attractive display and dispensing carton, which is particularly adaptable to the pharmaceutical or drug, cosmetic, and related merchandising fields.

SUMMARY OF THE INVENTION

It is accordingly an object of the present invention to provide a novel display and dispensing carton which is attractive and suitable for the intended use, but which may be erected on the spot from a blank of suitable, inexpensive material such as paperboard. A further object is to provide such a carton having a novel configuration for the presentation of the product contained therein through a suitable diagonally-constituted display and dispensing opening. Another object is the provision of such a carton which comprises novel locking means as an integral part thereof for maintaining the various panels of the said carton in juxtaposition and the carton, accordingly, in erected position. A further object is the provision of such a display and dispensing carton having improved resiliently-biased follower means therein, and a still further object of the invention is the provision of such a carton wherein the resilient bias for the follower is provided by a coil spring having parallel circular front and rear end convolutions located between the follower and the carton rear panel, and preferably but not necessarily secured to the carton rear panel by a novel slot or slit arrangement therein. A still additional object is the provision of such a carton wherein the top panels are shorter than the bottom panel and the front panel is shorter than the width of the side panels, and wherein the side panels slope rearwardly to the front edge of the top panels from a point spaced from the bottom panel a distance approximately equal to the height of the front panel, whereby the front portion of the carton provides a diagonally cut-away appearance for providing the display and dispensing opening thereof. Yet another object of the invention is the provision of integral blanks adapted and suitable for erection into the cartons of the invention. The accomplishment of the foregoing and additional objects will become fully apparent hereinafter, and still other objects will be apparent to one skilled in the art to which this invention appertains.

DESCRIPTION OF THE PREFERRED EMBODIMENTS

The invention, in a preferred embodiment, is illustrated by the accompanying drawings, in which:

FIGS. 1–6 are presented in reduced dimension, namely, one-half size, whereas

FIG. 7 is a longitudinal sectional view of a display and dispensing carton of the invention with merchandise therein;

FIG. 8 is a sectional view along line 8 — 8 of FIG. 7, and

FIG. 9 is a sectional view similar to FIG. 8 but taken further toward the back of the carton through the second top lock tab and showing the coil spring anchored to the carton rear wall.

SPECIFIC REFERENCE TO THE DRAWINGS

Reference is now made to the accompanying drawings for a better understanding of the invention, wherein all the parts are numbered and wherein the same numbers are used to refer to corresponding parts throughout.

Figure 1:
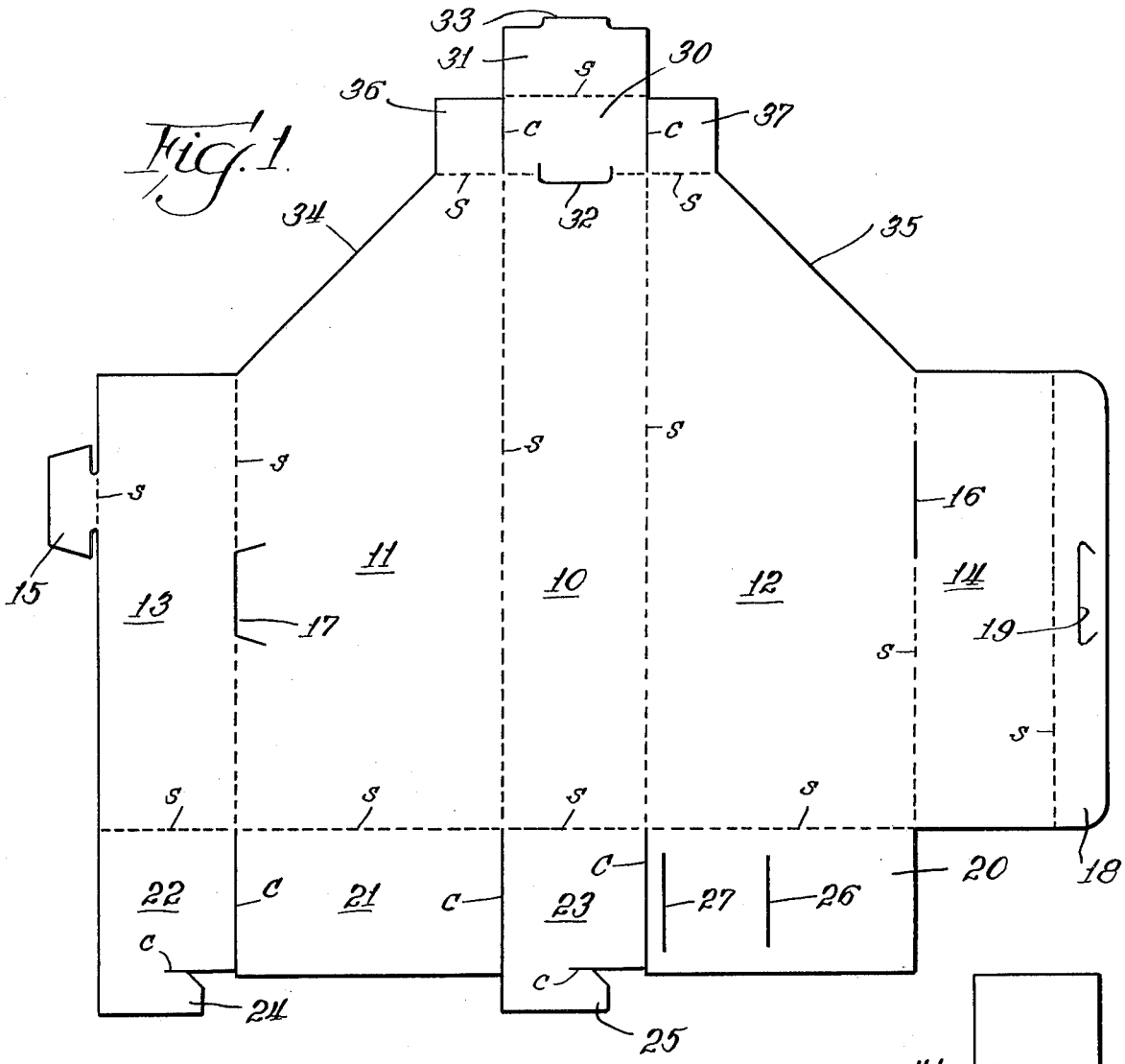
FIG. 1 is a plan view of a carton blank cut and scored for assembling a display and dispensing carton having the novel features of the invention, looking at the side which will be inside upon erection of the carton.

In the preferred form of the invention, a display and dispensing carton may be constructed from an integral blank, as illustrated in FIG. 1, which comprises a bottom-forming panel 10, designed to be the bottom of the erected carton, a first side-forming panel 11, a second side-forming panel 12, both side-forming panels being hingedly connected to bottom-forming panel 10 along score or fold lines S. Joined to side-forming panel 11 along a further score or fold line S is overlying top-forming panel 13, and joined to the second side-forming panel 12 along a further score line S is underlying top-forming panel 14. Completing the major body of the blank is flap-forming panel 18, in turn connected to underlying top-forming panel 14, also along a score or fold line S. Lock tab 15 on the leading edge of top-forming panel 13 has corresponding slit 16 substantially at the fold line between side-forming panel 12 and underlying top-forming panel 14, whereas first slit 19 in flap-forming panel 18 corresponds with tab-forming slit 17 in side-forming panel 11. As shown, first slit 19 is U-shaped, and has a bight which is substantially a straight line parallel to the fold line at the juncture of flap-forming panel 18 and underlying top-forming panel 14. The legs of this U-shaped slit project toward the edge of the flap-forming panel 18 and the edge of the tab-forming slit 17 in side-forming panel 11 is complementary to the bight of U-shaped first slit 19. Moreover, the tab-forming slit 17 is in a proper position and has proper dimensions so as to cooperate fully with said U-shaped slit 19, its free edge being substantially coincident with the fold line at the juncture of top-forming panel 13 and first side-forming panel 11. The sides of this tab-forming slit 17 moreover project away from said fold line a distance substantially equal to the distance between said first slit 19, particularly the bight thereof, and the fold line at the juncture of underlying top-forming panel 14 and flap-forming panel 18. Said slits are both located generally toward the mid-section of the top-forming panels.

As will be noted, said top-forming panels 11 and 12 are shorter than said bottom-forming panel 10, and the front end panel or first portion of said front end-forming panel means 30 as well as the second portion of said front end-forming panel means 31 is shorter than the width of said side-forming panels 11 and 12. At the leading edge of front end-forming panel means, in particular at the leading edge of the second portion of said front end-forming panel means 31, is found end panel lock tab 33, whereas complementary front end panel lock cut 32 is located in bottom-forming panel 10 at approximately the juncture of said bottom-forming panel and said first portion of front end-forming panel means 30.

Attached to side-forming panels 11 and 12 are extensions 36 and 37, respectively, both being attached to the main body of said side panels along score lines, and both being separated from said front end-forming panel means first section 30 by cuts C. Extensions 36 and 37 are of a width approximately equal to the length of said front end-forming panel portion 30 and are adapted to be folded in and between the front end-forming panel portions 30 and 31 thereby to provide underlying front panel support means upon erection of the carton. The front end of the carton is adapted to be secured in place by insertion of tab 33 into slit 32, upon erection of the carton.

The remainder of the carton blank comprises rear end panel-forming means including underlying rear end-forming panel 20 and overlying rear end-forming panel 21, respectively joined to side-forming panels 12 and 11 along score lines S. Alternatively, the panel desired to be the underlying rear end-forming panel can be attached along a suitable score line to side-forming panel 11. Integral means is provided for holding said rear end-forming panels in juxtaposition when said blank is erected into a carton, as shown in the form of lock panels 22 and 23, respectively joined along fold or score lines to the overlying top-forming panel 13 and the bottom-forming panel 10, and each respectively having its own lock tab portion 24 and 25. Panels 20 and 23; 23 and 21; 21 and 22 are separated from each other by cuts C and lock tab portions 24 and 25 of lock panels 22 and 23 are respectively separated from them to the extent necessary by cuts C. In underlying rear end-forming panel 20 are found slits 26 and 27, optionally and preferably provided for the anchoring therein of spring biasing means as will be discussed further hereinafter.

As will be observed from FIG. 1, side-forming panels 11 and 12 are slant cut on a diagonal at 34 and 35, from the score line at which they are respectively joined to extensions 36 and 37 and up to the score lines at which they respectively adjoin overlying top-forming panel 13 and underlying top-forming panel 14.

Figure 2:
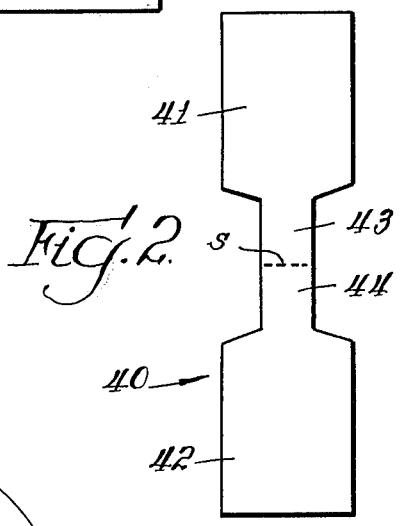
FIG. 2 is a top plan view of a follower which may be employed according to the present invention.
Figure 7:
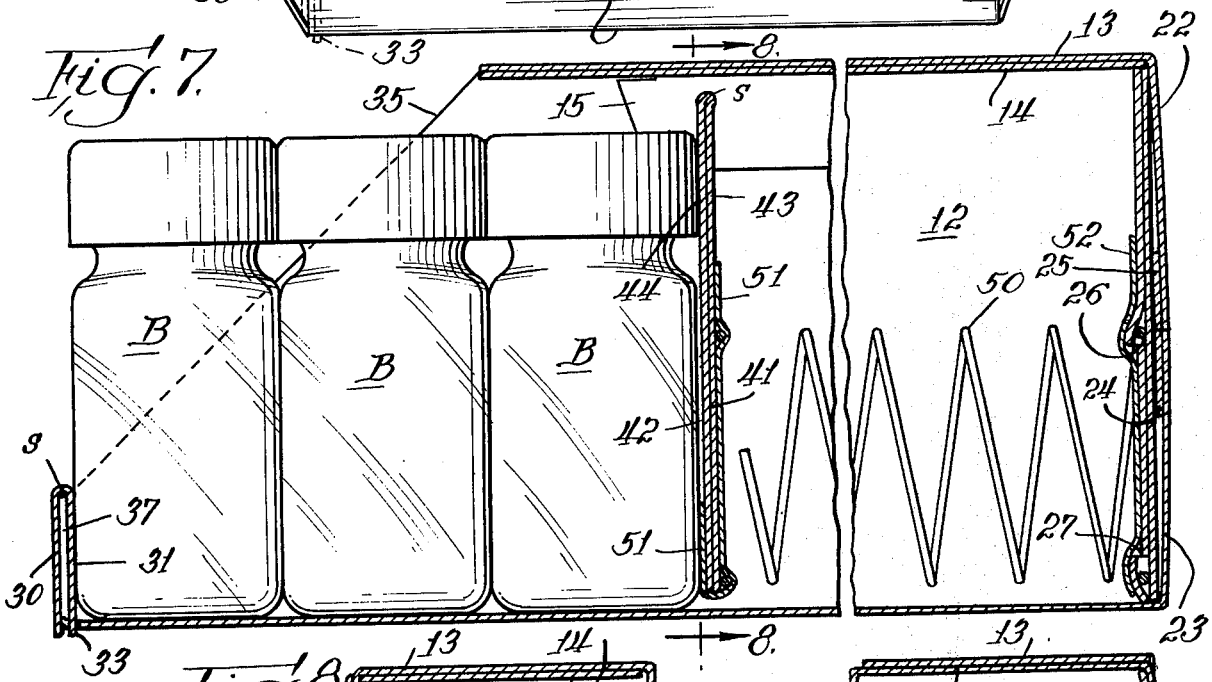
FIGS. 7–9 are presented full size.
Figure 6:
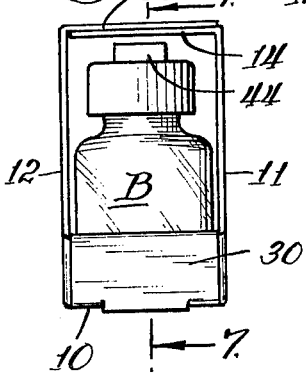
FIG. 6 is a front view of a carton of the invention fully erected and with merchandise therein.

FIG. 2 shows the follower 40, including main body portions 41 and 42 and narrower upper portions 43 and 44, designed to be folded upon itself along score line S. The narrower upper part is to allow insertion of fingers into the dispensing and display carton in case the follower should stick, and also for correspondence with the shape of the merchandise employed in this particular embodiment, namely, bottles B as shown in FIGS. 6 and 7.

Figure 3:
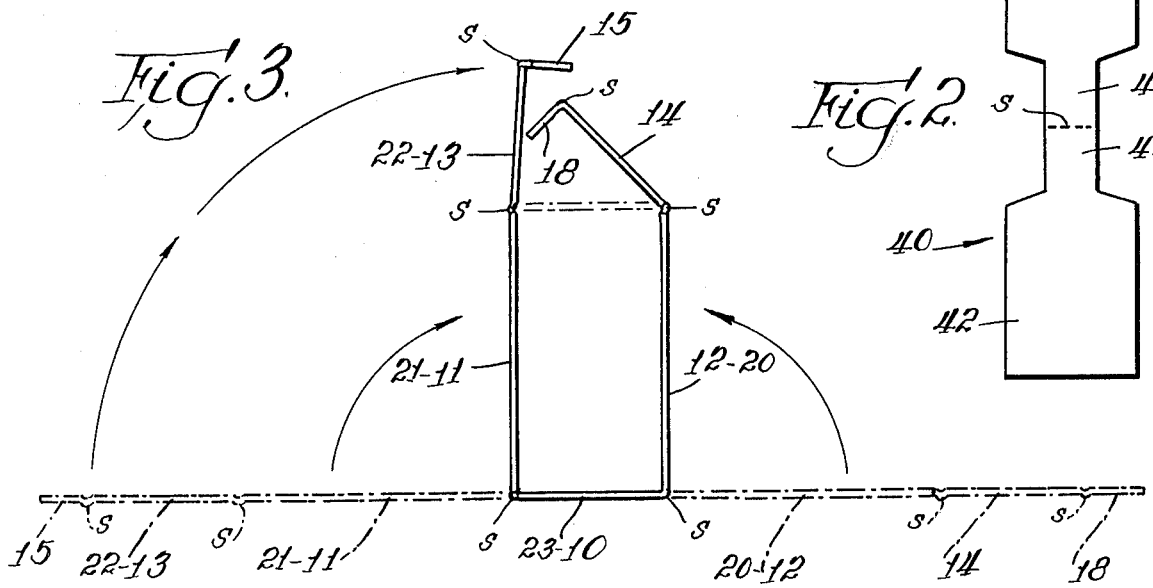
FIG. 3 is a rear view of the display and dispensing carton of the invention partially assembled.

As shown in FIG. 3, the carton of the invention is erected from the blank of FIG. 1 by first folding the side-forming panels 11 and 12, with their appended extensions 36 and 37 and rear end-forming flaps 21 and 20, about the score lines along which they adjoin bottom-forming panel 10. FIG. 3 shows side-forming panels 11 and 12 at an approximately 90° angle with respect to bottom-forming panel 10. Lock tab 15 is bent normal with respect to the leading edge of overlying top-forming panel 13 along the score line S provided for this purpose, and flap-forming panel 18 is likewise bent normal with respect to underlying top-forming panel 14 along score line S therebetween. FIG. 3 shows underlying top-forming panel 14 bent along score line S approximately 45° with respect to side-forming panel 12 just prior to inserting the tab formed by tab-forming slit 17 into the slit 19 carried by flap-forming panel 18.

Figure 4:
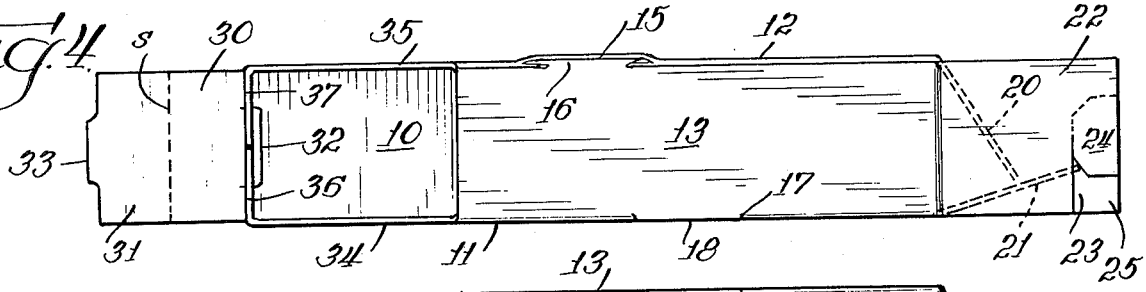
FIG. 4 is a top view of a carton according to the invention further along in the process of assembly.

FIG. 4 shows a top view of the carton further assembled. Lock tab 15 has been inserted into slit 16. The tab formed by tab-forming slit 17 has been inserted into U-shaped slit 19. In this form, the carton is stabilized. Extensions 36 and 37 have been bent inwardly to provide underlying front end panel support means upon continuation of the carton erection, and rear end-forming panels 20 and 21 are being folded upon each other preparatory to locking them in place with lock panels 22 and 23 and their respective interlocking portions 24 and 25.

Figure 5:
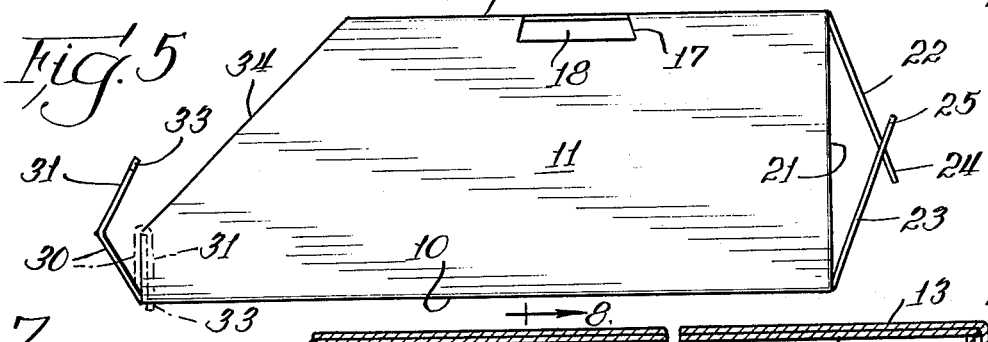
FIG. 5 is a side view of a carton of the invention still further along in the process of assembly.

In FIG. 5, the carton is shown from a side view in still further assembled condition. Lock panels 22 and 23 are being folded into final position. Front end-forming panel means comprising first front-forming panel portion 30 and second front-forming panel portion 31 are shown being folded over the bent-in extensions 36 and 37 along their central fold line S and front panel lock tab 33 at the leading edge of second front-forming panel portion 31 is shown about to be finally folded and received in complementary front panel lock cut 32 at approximately the juncture of said bottom-forming panel 10 and said front-forming panel portion 30. The tab formed by tab-forming slit 17 is shown secured in slit 19 of flap-forming panel 18, said panel 18 showing through the aperature thus provided in the side-forming panel 11.

FIG. 6 shows a front view of the erected display and dispensing carton with merchandise in the form of bottles B therein. First portion of front-forming panel 30, bottom panel 10, side panels 11 and 12, underlying and overlying top panels 14 and 13, and the neck 44 of follower 40 are all visible. It is to be noted that the merchandise B is readily seen through the display and dispensing opening provided in the front of the carton.

FIG. 7 is a longitudinal sectional view of the filled display and dispensing carton along the line 7 — 7 of FIG. 6. All of the elements previously mentioned are clearly seen from FIG. 7, and in addition coil spring 50 having parallel circular front and rear end convolutions, located between the follower and attached by pressure-sensitive adhesive tape 51 to main body panel 41 thereof is apparent. The slant cut or diagonal 35, providing the dispensing and display opening, is also clearly apparent. The merchandise B within the carton is being urged toward the display and dispensing opening by the spring-biased follower. The rear end construction involving lock panels 22 and 23 with their interlocking tabs 24 and 25 as well as slots in end panel 20 receiving the top segment of the rear convolution of spring 50 and the lower segment of the rear convolution of said spring 50, resepectively, are all apparent. In addition, this Figure shows pressure-sensitive adhesive strip 52 superposed over the convolutions of spring 50 as received and retained in slits 26 and 27, further securing the rear end convolution of said spring to inner rear flap 20. This view also shows lock tab 15 as received within slit 16 for holding the overlying top panel 13 to the underlying top panel 14.

Figure 8:
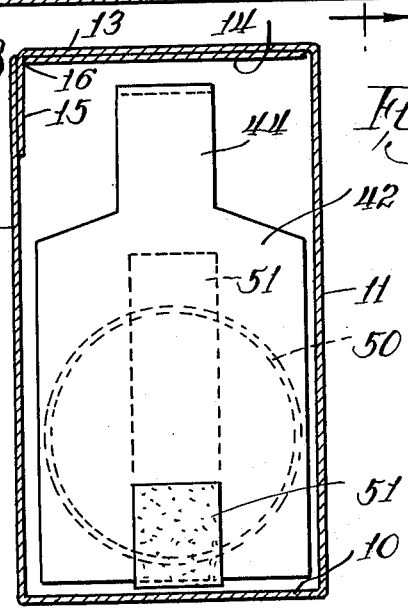

FIG. 8, is a sectional view along line 8 — 8 of FIG. 7, shows neck portion of follower 44, body portion of follower 42, pressure sensitive adhesive strip 51 on the front and back of the follower securing the front convolution of spring 50 thereto. The Figure is completed by bottom panel 10, side panels 11 and 12, top panels 13 and 14, the carton being shown secured together by virtue of insertion of tab 15 in slit 16 at the upper left hand corner of the Figure.

Figure 9:
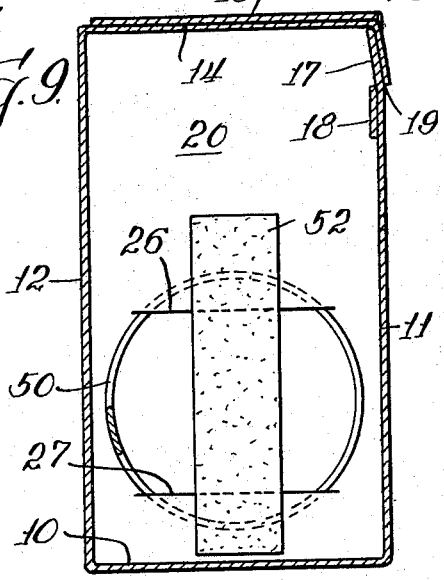

FIG. 9 shows another sectional view further back toward the rear of the carton, and again shows bottom 10, sides 11 and 12, and top panels 13 and 14. Spring 50 is shown secured to inner panel 20 by insertion in slits 26 and 27 and further securement thereto by pressure sensitive strip 52. Flap-forming panel 18 with its receiving slit 19 is also shown, with the tab formed by tab-forming slip 17 in side panel 11 secured within said slit 19.

Thus, front panel lock tab 33 and complementary front panel lock cut 32, together with the tab formed by tab-forming slit 17 and complementary slit 19 in flap-forming panel 18, and lock tab 15 together with its complementary slit 16, as well as rear lock panels 22 and 23 with their respective lock tabs 24 and 25, provide integral means for holding all of the panels of the display and dispensng carton together.

In operation, the merchant or other party at the point of display desiring to set up the display and dispensing carton follows the procedure outlined in the foregoing, inserts the necessary merchandise such as the bottles B through the display and dispensing opening formed by the slant or diagonal cuts 34 and 35 in sides 11 and 12, each succeeding piece of merchandise increasing the spring bias by pushing the follower 40 toward the rear of the carton, until the desired amount of merchandise has been inserted therein. The display and dispensing carton, with merchandise therein, is thereupon placed at the point of display or point or sale, the foremost merchandise being readily observable through the display and dispensing opening and each succeeding merchandise object being resiliently biased by the follower thus serially to urge the merchandise in the carton toward the display and dispensing opening for display and ready removal thereof. As soon as the foremost object has been removed by the customer or merchant, the next is serially urged into its place by the resiliently-biased follower, until the carton is empty of merchandise. At this time it can be refilled, and the process continued, ad infinitum. When and if the display and dispensing carton, for whatever reason, comes into a state of disrepair or becomes sufficiently unattractive so that it is desired to dispense with it, this represents no great economic loss and it can be readily replaced with a new display and dispensing carton which, in its turn, can be readily and economically erected by the merchant or his display expert on the spot.

From the foregoing, it will be seen that all of the objectives of the invention have been attained in a ready, facile, and economical manner. It is, however, to be understood that the invention is not limited to the exact details of construction, operation, or exact materials or embodiments shown and described, as obvious modifications and equivalents will be apparent to one skilled in the art. For example, other locks means or other means, for example pressure-sensitive adhesive, may be employed for securing the overlying top panel to the underlying top panel. Alternatively, other types of lock flaps, or a full flap or flaps bearing pressure-sensitive adhesive, may be employed as overlying rear end panel or panels for securing the underlying rear end panels in position. Similarly, other means may be employed for providing the front end panel, for example one or both of the front-panel forming portions may bear pressure-sensitive adhesive for securing the front panel in place around the side-panel extensions, or still other equivalent means may be employed. Still alternatively, the coil spring may be attached to the inner rear panel of the carton by means of a pressure-sensitive adhesive strip alone, without employing slits in the inner rear panel, or in combination with a coil-corresponding crease or press score in the inner rear panel, or still other means may be employed in such non-preferred embodiment. Wherefore, the invention is to be limited only by the scope of the appended claims.

We claim:

1. A display and dispensing carton blank having an overlying top-forming panel, a first side-forming panel, a bottom-forming panel, a second side-forming panel, an underlying top-forming panel, and a flap-forming panel, all hingedly connected to each other in the order given along parallel fold lines, front end-forming panel means and back end-forming panel means, and integral means for holding said panels together in assembled form, said top-forming panels being shorter than said bottom-forming panel, the front panel of said front-forming panel means being shorter than the width of said side-forming panels, and said side-forming panels sloping rearwardly to the front edge of said top-forming panels from a point spaced from the bottom-forming panel a distance equal to the height of the front panel of said front-forming panel means whereby, when the blank is erected into carton form, the front portion is cut away diagonally to form a display and dispensing opening, said integral means comprising fastening means for fastening said flap-forming panel to said first side-forming panel with the fold line between said flap-forming panel and said underlying top-forming panel being juxtaposed throughout its length with the fold line between said overlying top-forming panel and said first side-forming panel and securing means for securing the overlying top-forming panel in juxtaposition to the underlying top-forming panel.

2. A display and dispensing carton blank according to claim 1, wherein said securing means is a lock tab extending from the leading edge of said overlying top-forming panel and said a complementary slit substantially at the fold line at the juncture of said second side-forming panel and said underlying top-forming panel.

3. A display and dispensing carton blank according to claim 1, wherein the rear panel-forming means comprises an underlying rear end-forming panel joined to one side-forming panel along a fold line and an overlying rear end-forming panel joined to the other side-forming panel along a fold line, and integral means comprises holding means for holding said rear-forming panels in juxtaposition when said blank is erected into a carton.

4. A display and dispensing carton blank according to claim 3, wherein the said holding means comprises cooperating lock panels joined along fold lines to the overlying top-forming panel and the bottom-forming panel.

5. A display and dispensing carton blank according to claim 1, wherein the front-forming panel means comprises a first front panel-forming portion and a second front panel-forming portion of approximately equal dimensions, both being of greater width than length and said first portion being hingedly connected to said bottom-forming panel along a fold line, said portions being hingedly connected together along a central fold line and adapted to be folded upon each other, a front panel lock tab at the leading edge of said second front panel-forming portion and a complementary front panel lock slit at approximately the juncture of said bottom-forming panel and said first portion of said front-forming panel means.

6. A display and dispensing carton blank according to claim 5, comprising complementary extensions of the two side-forming panels attached to said side-forming panels along fold lines and adapted to be folded in and between the front-forming panel portions and of a width approximately equal to the length of one of said front-forming panel portions, thereby to provide underlying front-panel support means upon erection of the carton.

7. A display and dispensing carton blank according to claim 3, wherein the underlying rear-forming panel has two substantially parallel slits generally normal to its fold line with a side-forming panel, one of which slits is near the bottom-forming panel, for anchoring of coil spring resilient biasing means thereto upon erection of a carton from said blank.

8. A display and dispensing carton erected from the integral carton blank of claim 1.

9. A display and dispensing carton erected from the integral carton blank of claim 2.

10. A display and dispensing carton erected from the integral carton blank of claim 3.

11. A display and dispensing carton erected from the integral carton blank of claim 4.

12. A display and dispensing carton erected from the integral carton blank of claim 5.

13. A display and dispensing carton erected from the integral carton blank of claim 6.

14. A display and dispensing carton erected from the integral carton blank of claim 7.

15. A display and dispensing carton according to claim 8, having therein a resiliently-biased follower adapted serially to urge merchandise placed in said carton toward the display and dispensing opening for display and ready removal thereof, said follower being resiliently-biased in said carton by means of a coil spring having parallel circular front and rear end convolutions, the front end convolution of said spring being secured to said follower and the rear end convolution of said spring being secured to the inside rear panel of said carton.

16. A display and dispensing carton according to claim 8, having therein a resiliently-biased follower adapted serially to urge merchandise placed in said carton toward the display and dispensing opening for display and ready removal thereof, said follower being resiliently-biased by means of a coil spring having parallel circular front and rear end convolutions located between said follower and the inside rear panel of said carton, the front end convolution of said spring being secured to said follower and the rear end convolution of said spring being secured to the inside rear panel of said carton by means comprising substantially parallel slits in said rear panel, one slit receiving a top segment of said rear convolution and the other slit receiving a bottom segment of said rear convolution of said coil spring.

17. In a display and dispensing carton having parallel side panels, parallel top and bottom panels, and parallel front and rear panels, characterized in that the top panel is shorter than said bottom panel, in that the front panel is shorter than said rear panel, and in that the side panels slope rearwardly from the top edge of the front panel to the front edge of the top panel, thereby forming a display and dispensing opening, and further characterized by having a resiliently-biased follower adapted serially to urge merchandise placed in said carton toward the display and dispensing opening for display and ready removal thereof, the improvement wherein said resilient bias is provided by a coil spring having parallel circular front and rear end convolutions, said spring being located between the rear panel and the follower and wherein one end convolution of said spring is fastened to the rear panel rear convolution, the front convolution of said spring being fastened to said follower.

18. A display and dispensing carton according to claim 17, wherein the end convolution of said spring which is fastened to the rear panel is fastened thereto by means comprising substantially parallel slits in the rear panel, one slit adapted to receive a top segment of said rear convolution and the other slit adapted to receive a bottom segment of said rear convolution.

19. A display and dispensing carton blank according to claim 1, wherein said integral means for holding said panels together in assembled form comprises a first slit in said flap-forming panel spaced from the fold line at the juncture of the flap-forming panel and the underlying top-forming panel, a tab-forming slit in said first side-forming panel for providing a tab adapted to be complementary to said first slit in position and dimensions and substantially coincident with the fold line at the juncture of the overlying top-forming panel and the first side-forming panel and the sides of which tab-forming slit project away from the said fold line into said first side-forming panel a distance substantially equal to the distance between said first slit and the fold line at the juncture of the underlying top-forming panel and flap-forming panel whereby, when the tab of said tab-forming slit is inserted into said first slit upon erection of the carton from said blank, the underlying top-forming panel is supported and held in juxtaposition to the overlying top-forming panel.

20. A display and dispensing carton blank according to claim 19, wherein said first slit is U-shaped and has a bight which is substantially a straight line parallel to the fold line at the juncture of the flap-forming panel and the underlying top-forming panel and the legs of which project toward the edge of said flap-forming panel, and wherein the tab-forming slit has a free edge which is complementary to the bight of said U-shaped first slit and wherein the sides of the tab-forming slit project away from said fold line a distance substantially equal to the distance between the bight of the U-shaped slit and said fold line.

21. A display and dispensing carton blank according to claim 19, wherein said first slit and said tab-forming slit are located generally toward the mid-section of said top-forming panels, and wherein said securing means is located forward of said first slit and tab-forming slit toward the front end of the top-forming panels.

22. A display and dispensing carton erected from the integral carton blank of claim 19.

23. A display and dispensing carton erected from the integral carton blank of claim 20.

24. A display and dispensing carton erected from the integral carton blank of claim 21.

* * * * *

UNITED STATES PATENT OFFICE

CERTIFICATE OF CORRECTION

Patent No. 4,020,946 Dated May 3, 1977

Inventor(s) Marshall J. Gardner et al.

It is certified that error appears in the above-identified patent and that said Letters Patent are hereby corrected as shown below:

Column 1, line 36; change "numerouse" to ---numerous---.

Column 2, line 2; point of display or point of sale; change to read ---"point of display" or "point of sale"---.

Column 3, line 67; change "found end panel" to read ---found front end panel---.

Column 5, line 63; change "FIG. 8, is a sectional" to read ---FIG. 8, a sectional---.

Column 6, line 20; change "dispensng" to read ---dispensing---.

Column 7, line 42; change "and said a" to read ---and a---.

line 51; change "and integral" to read ---and said integral---.

line 56; change "wherein the said holding" to read ---wherein said holding---.

Signed and Sealed this second Day of August 1977

[SEAL]

Attest:

RUTH C. MASON
*Attesting Officer*

C. MARSHALL DANN
*Commissioner of Patents and Trademarks*